US009506313B2

(12) United States Patent
Jahnke

(10) Patent No.: US 9,506,313 B2
(45) Date of Patent: Nov. 29, 2016

(54) CONTOURED RAM BORE ON TYPE U BLOWOUT PREVENTER

(75) Inventor: Douglas Jahnke, Houston, TX (US)

(73) Assignee: T-3 PROPERTY HOLDINGS, INC., Houston, TX (US)

( * ) Notice: Subject to any disclaimer, the term of this patent is extended or adjusted under 35 U.S.C. 154(b) by 417 days.

(21) Appl. No.: 14/007,056

(22) PCT Filed: Apr. 23, 2012

(86) PCT No.: PCT/US2012/034696
§ 371 (c)(1),
(2), (4) Date: Oct. 21, 2013

(87) PCT Pub. No.: WO2012/148857
PCT Pub. Date: Nov. 1, 2012

(65) Prior Publication Data

US 2014/0034293 A1 Feb. 6, 2014

Related U.S. Application Data

(60) Provisional application No. 61/479,192, filed on Apr. 26, 2011.

(51) Int. Cl.
*E21B 33/06* (2006.01)

(52) U.S. Cl.
CPC ..... *E21B 33/062* (2013.01)

(58) Field of Classification Search
CPC ..... E21B 33/06; E21B 33/062
See application file for complete search history.

(56) References Cited

U.S. PATENT DOCUMENTS

| | | | | |
|---|---|---|---|---|
| 2,877,977 | A * | 3/1959 | Allen | E21B 33/062 175/207 |
| 3,744,749 | A | 7/1973 | Le Rouax | |
| 6,296,225 | B1 | 10/2001 | Watts | |
| 2003/0024705 | A1 | 2/2003 | Whitby et al. | |
| 2003/0085040 | A1 | 5/2003 | Hemphill et al. | |

* cited by examiner

*Primary Examiner* — William P Neuder
(74) *Attorney, Agent, or Firm* — Conley Rose, P.C.

(57) ABSTRACT

The disclosure provides a Type U blowout preventer (BOP) that includes a body generally coupled with a set of bonnets. The bore of the body differs from conventional Type U BOPs. The bore of the body is formed with a contour that allows differential engagement with a ram having ram seals at different places along the bore. Further, the coupling between the bonnet and body can optionally be different from conventional Type U BOPs. In at least one embodiment, the bonnet is coupled to the body in conjunction with a tube holding an extraction shaft with a head held to the bonnet with a retainer. The tube and extraction shaft allows the bonnet to be removed from the body without hydraulic external force.

21 Claims, 19 Drawing Sheets

CONTOURED RAM BORE ON TYPE U BLOWOUT PREVENTER

CROSS REFERENCE TO RELATED APPLICATIONS

This application is a National Stage application under 35 U.S.C. §371 of International Application No. PCT/US2012/034696, filed Apr. 23, 2012, which claims the benefit of U.S. Provisional Application No. 61/479,192, filed Apr. 26, 2011.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates oil field equipment. More particularly, the disclosure relates to the blowout preventers.

Description of the Related Art

In gas and oil wells, it is sometimes necessary to seal against or even shear a tubular member disposed therein and seal the wellbore to prevent an explosion or other mishap from subsurface pressures. Typically, the oil field equipment performing such a function is known as a blowout preventer ("BOP"). A BOP has a body that typically is mounted above a well as equipment in a BOP stack.

FIG. 1A is a perspective schematic view of a typical prior art Type U blowout preventer ("BOP"). FIG. 1B is a top schematic view of the Type U blowout preventer of FIG. 1A. Portion "A" of FIG. 1B shows the BOP assembled, and portion "B" of FIG. 1B shows the BOP disassembled in part with a bonnet separated from the main body of the BOP. The most widely used BOPs are known as a Type U blowout preventer. A typical Type U BOP 2 has a body 4 with a through-bore 6 having a longitudinal centerline 7 through which a drill pipe or other tubular member can extend. Bonnets 8 are mounted on opposing sides of the body 4 to extend laterally from the body and enclose various hydraulic and mechanical components. A plurality of bolts 9 firmly attach the bonnets 8 to the body 4 of the BOP. Opposing ram bores 10 are formed in the body 4 and align with the opposing bonnets 8. The ram bores 10 are disposed transverse, generally perpendicular, to the longitudinal centerline 7 of the through-bore 6. Type U rams 12 are slidably disposed in the ram bores 10 to move axially along the ram bores. The rams 12 are slidably sealed with the walls of the ram bores with elastomeric ram seals disposed on the rams, having a top ram seal 14 and a side ram seal 16 on each side. The ram seals 14, 16 form a characteristic "U" shape that allows sealing along the sides with the side ram seal 16 closer to the leading edge 13 of the ram (that is, toward the through-bore 6) and sealing along the top of the ram with the top ram seal 14 distal from the leading edge 13 to allow space for blades, other seals, and various other components that would be exposed to the pressure in the through-bore 6. Actuators are disposed in the bonnets and connected at the outward ends of the rams 12 to cause the rams to move along the ram bores 10, and close around or shear drill pipe disposed in the through-bore. A hydraulic actuator 18, such as a piston, can be disposed in a chamber 20 in the bonnet 8. Hydraulic pressure exerted on an outward face 22 of the actuator forces the piston and the ram coupled to the piston to move inwardly toward the through-bore 6. A mechanical actuator 24 can be used in lieu of the hydraulic actuator. The mechanical actuator 24 can include a threaded shaft that engages a slidable shaft coupled to the ram 12, so that the ram can be screwed inwardly toward the through-bore by turning the shaft inside a housing 25 attached to the bonnet. Different types of blades can be coupled with the rams 12 depending on the style of the blowout preventer, and typically include "pipe," blind, or shear blades.

When closed around the pipe or having sheared the pipe, depending on the type of blade, the rams 12 are pressure-energized using wellbore pressure to increase the sealing force against a tubular product in the through-bore, and help maintain the seal in case of hydraulic pressure loss on the rams. Further, mechanical locking systems, wedgelocks, and other devices can also help hold the rams closed, if the hydraulic pressure loss occurs.

However, the pressure-energized and locking aspects assume the ram seals 14 are in a suitable condition to seal under the pressure. Ram seals 14, 16 on a Type U BOP are in a constant state of compression while at any position within the ram bore. As the sealing elastomer ages, it has the potential to lose elasticity while in its compressed shape, thus reducing sealing characteristics when it may be needed, potentially years later on a wellhead.

Additionally, because the Type U BOP ram 12 seals along the entire length of the ram bore 10 with the ram seals 14, 16, disassembly is not generally performed manually due to the force required to pull the ram out of the ram bore. The disassembly and removal of the ram (and the bonnet) is done with hydraulic force. For example, a ram change shaft 26 can be inserted through a ram change chamber 30 in the bonnet 8 and threaded into the BOP body 4. An outward end of the shaft 26 can include a piston 28 sealingly engaged with the chamber 30.

To disassemble the BOP, the bolts 9 can be removed and hydraulic pressurized fluid applied to the ram that fills into the chamber 20 and is ported into ram change chamber 30. The fluid pressure fills the chamber 30 and pushes the bonnet 8 away from the main body 4 of the BOP, as shown in the portion "B" on the right side of FIG. 1B. The ram 10 has been removed from the ram bore 12 and the bonnet and components attached thereto can be removed from the body, and replaced or repaired.

However, this dependency on hydraulic pressure to disassemble the Type U BOP can lead to two challenges. There must be hydraulic pressure. If the hydraulic system is unavailable through power loss or failure, the BOP is difficult to dissemble manually. Further, the hydraulic ram change feature on Type U BOPs is expensive to manufacture.

Therefore, there remains a need for improved blowout preventer to be able to improve the sealing characteristics of the rams in the BOP for containing the wellbore pressure, and reduce the need for a hydraulically operated system to remove the bonnet for replacement or repair of the internal components of the BOP.

BRIEF SUMMARY OF THE INVENTION

The disclosure provides a Type U blowout preventer (BOP) that includes a body generally coupled with a set of bonnets. The bore of the body differs from conventional Type U BOPs. The bore of the body is formed with a contour that allows differential engagement with a ram having ram seals at different places along the bore. Further, the coupling between the bonnet and body can optionally be different from conventional Type U BOPs. In at least one embodiment, the bonnet is coupled to the body in conjunction with a tube holding an extraction shaft with a head held to the bonnet with a retainer. The tube and extraction shaft allows the bonnet to be removed from the body without hydraulic external force.

The disclosure provides a Type U blowout preventer ("BOP") for an oil or gas well, comprising: a BOP body having a through-bore defining a centerline and configured to allow a tubular member to be disposed therethrough, the body having at least a first contoured ram bore formed transverse to the through-bore centerline, the contoured ram bore formed with at least three regions comprising a contour relief region formed outwardly away from the centerline of the through-bore, a contour sealing region disposed inwardly toward the through-bore, and a contour transition region therebetween, the contour transition region defining a side portion and an upper portion, wherein the side portion extends inwardly toward the through-bore relative to the upper portion, and wherein the contour relief region has a larger cross-sectional dimension compared to the contour sealing region; and a first ram slidably disposed in the first ram bore, the first ram having elastomeric seals to seal against the ram bore comprising a top ram seal disposed on top of the ram and a side ram seal disposed on each side of the ram with the side ram seal being disposed toward a leading edge of the ram toward the through-bore, and the top ram seal being disposed distal from the leading edge relative to the side seal.

The disclosure also provides a Type U blowout preventer ("BOP") for an oil or gas well, comprising: a BOP body having a through-bore defining a centerline and configured to allow a tubular member to be disposed therethrough, the body having at least a first contoured ram bore formed transverse to the through-bore centerline, the contoured ram bore formed with at least three regions comprising a contour relief region formed outwardly away from the centerline of the through-bore, a contour sealing region disposed inwardly toward the through-bore, and a contour transition region therebetween, the contour relief region having at least one cross-sectional dimension larger than the contour sealing region; a first ram slidably disposed in the first ram bore, the first ram having at least one elastomeric seal to seal against the ram bore; and a bonnet configured to be coupled to the body, the bonnet comprising an extraction system to disconnect the bonnet from the body, the extraction system comprising: a first tube fixedly coupled to the body and slidably coupled within at least a portion of the bonnet; and an extraction shaft rotatably coupled to the bonnet and slidably disposed at least partially within the tube, comprising: at least one shaft support portion slidably coupled to the tube to support the bonnet outside the tube; and at least one shaft engagement portion configured to engage a corresponding tube engagement portion and move the shaft longitudinally relative to the tube when the shaft is rotated.

The disclosure further provides a Type U blowout preventer ("BOP") for an oil or gas well, comprising: a BOP body having a through-bore defining a centerline and configured to allow a tubular member to be disposed therethrough, the body having at least a first contoured ram bore formed transverse to the through-bore centerline, the contoured ram bore formed with at least three regions comprising a contour relief region formed outwardly away from the centerline of the through-bore, a contour sealing region disposed inwardly toward the through-bore, and a contour transition region therebetween, the contour relief region having at least one cross-sectional dimension larger than the contour sealing region; and a first ram slidably disposed in the first ram bore, the first ram having elastomeric seals to seal against the ram bore comprising a top ram seal disposed on top of the ram and a side ram seal disposed on each side of the ram with the side ram seal being disposed toward a leading edge of the ram toward the through-bore, and the top ram seal being disposed distal from the leading edge relative to the side seal.

DETAILED DESCRIPTION

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Some numbered elements herein are described with "A" and "B" suffixes to designate corresponding parts of the same or similar element when appropriate, and such elements can be generally referenced herein as the number without the suffix.

The disclosure provides a Type U blowout preventer (BOP) that includes a body generally coupled with a set of bonnets. The bore of the body differs from conventional Type U BOPs. The bore of the body is formed with a contour that allows differential engagement with a ram having ram seals at different places along the bore. Further, the coupling between the bonnet and body can optionally be different from conventional Type U BOPs. In at least one embodiment, the bonnet is coupled to the body in conjunction with a tube holding an extraction shaft with a head held to the bonnet with a retainer. The tube and extraction shaft allows the bonnet to be removed from the body without hydraulic external force.

Figure 1A:
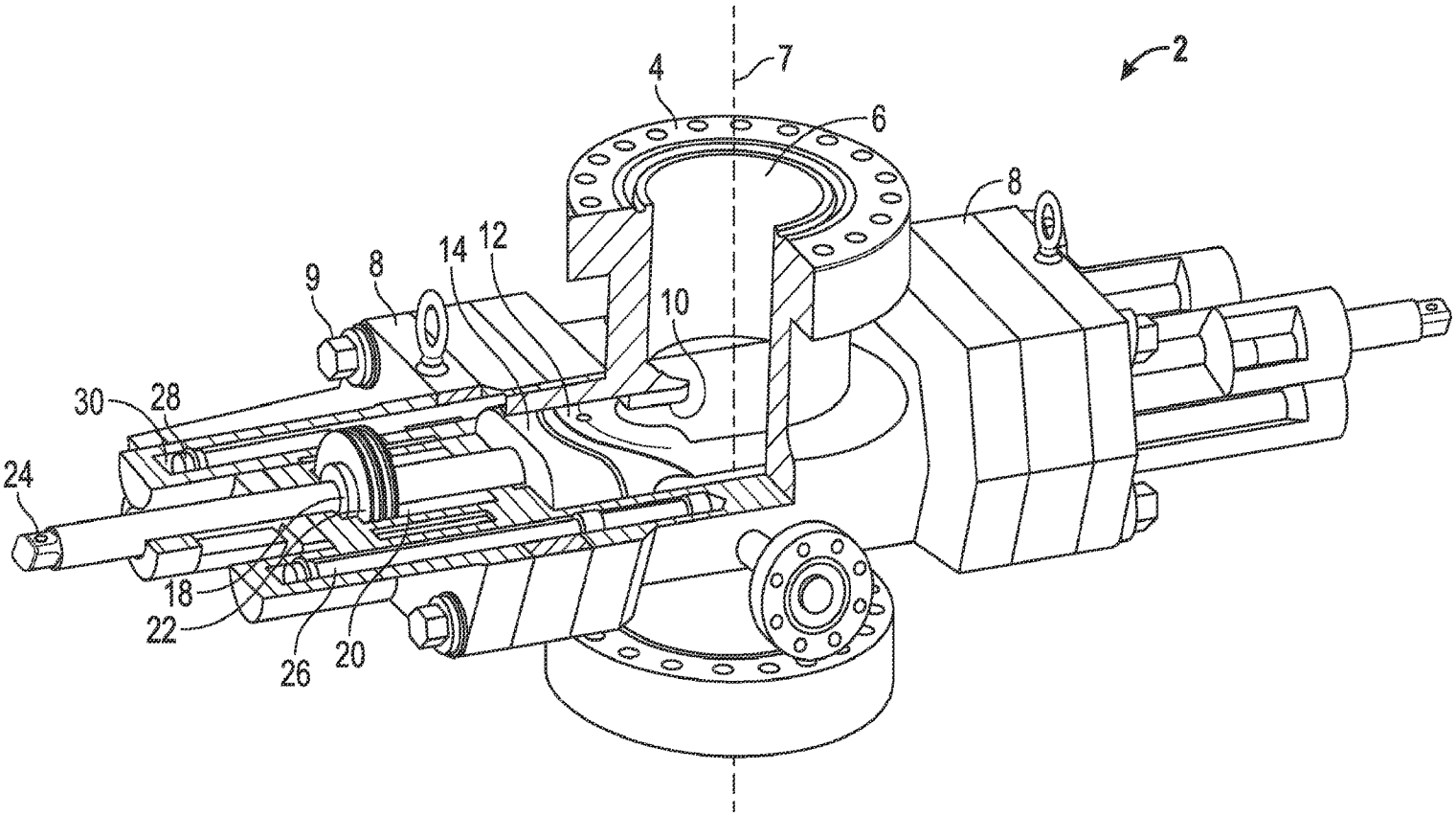
FIG. 1A (Prior Art)
FIG. 1A is a perspective schematic view of a typical prior art Type U blowout preventer ("BOP").
Figure 1B:
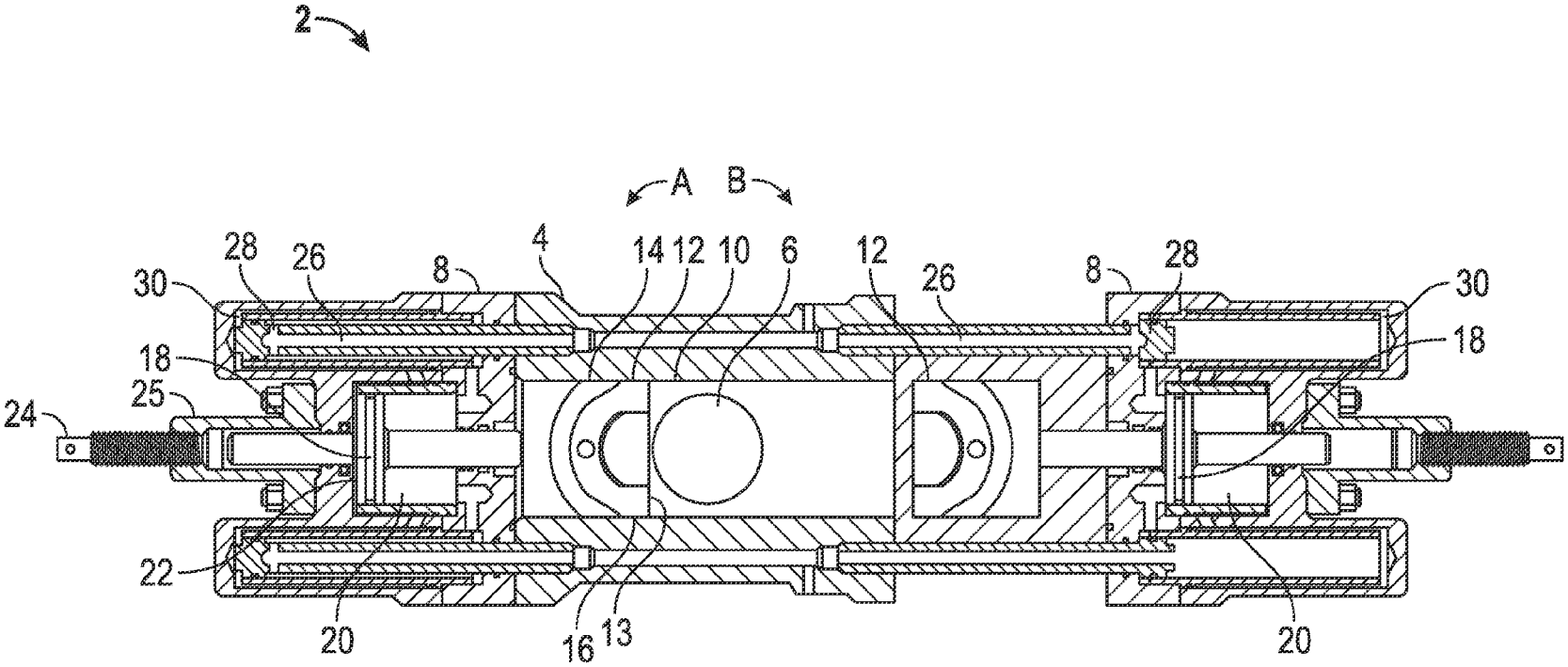
FIG. 1B (Prior Art)
FIG. 1B is a top schematic view of the Type U blowout preventer of FIG. 1A.
Figure 2:
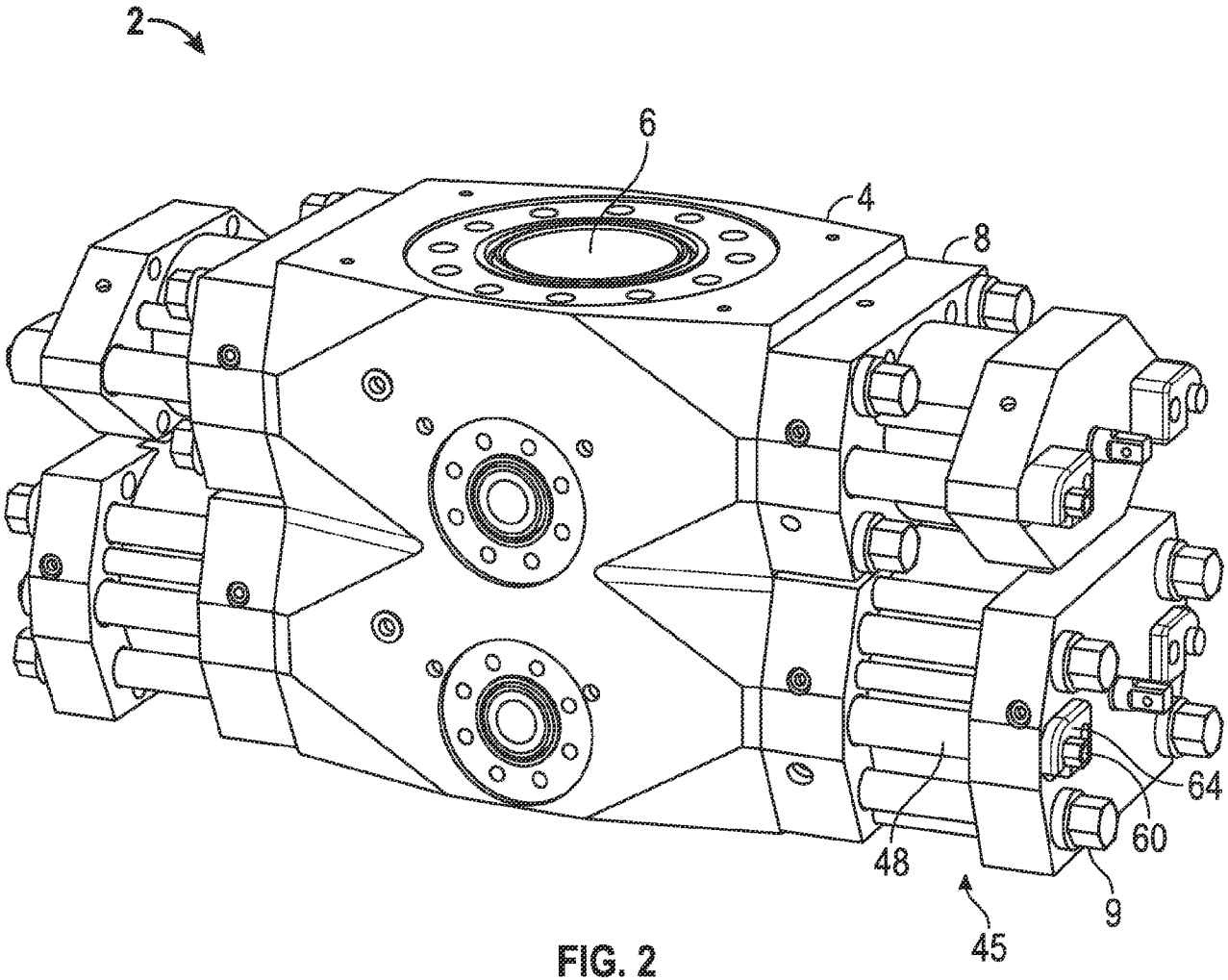
FIG. 2 is a perspective schematic view of a Type U BOP, according to the present invention.

FIG. 2 is a perspective schematic view of a Type U blowout preventer ("BOP"), according to the present invention. The figure shows a double stack of BOPs. The Type U BOP 2 of the present invention includes a body 4 generally coupled with an opposing set of bonnets 8 by a plurality of fasteners 9, such as bolts. The ram bore of the body 4, as described in more detail below, differs from conventional ram bores of Type U BOPs, such as described in FIGS. 1A, 1B. The ram bore of the body 4 is formed with a contour that allows differential engagement of internal ram seals with the bore at different places along the bore. Further, the coupling between the bonnet 8 and body 4 can optionally be different from conventional Type U BOPs. In at least one embodiment, the bonnet 8 is coupled to the body in conjunction with an extraction system 45 having a tube 48 holding an extraction shaft 50 with a head held to the bonnet with a retainer 64. The tube 48 and extraction shaft 50 allows the bonnet 8 to be removed from the body 4 without needing hydraulic external force to move the bonnet away from the body.

Figure 3A:
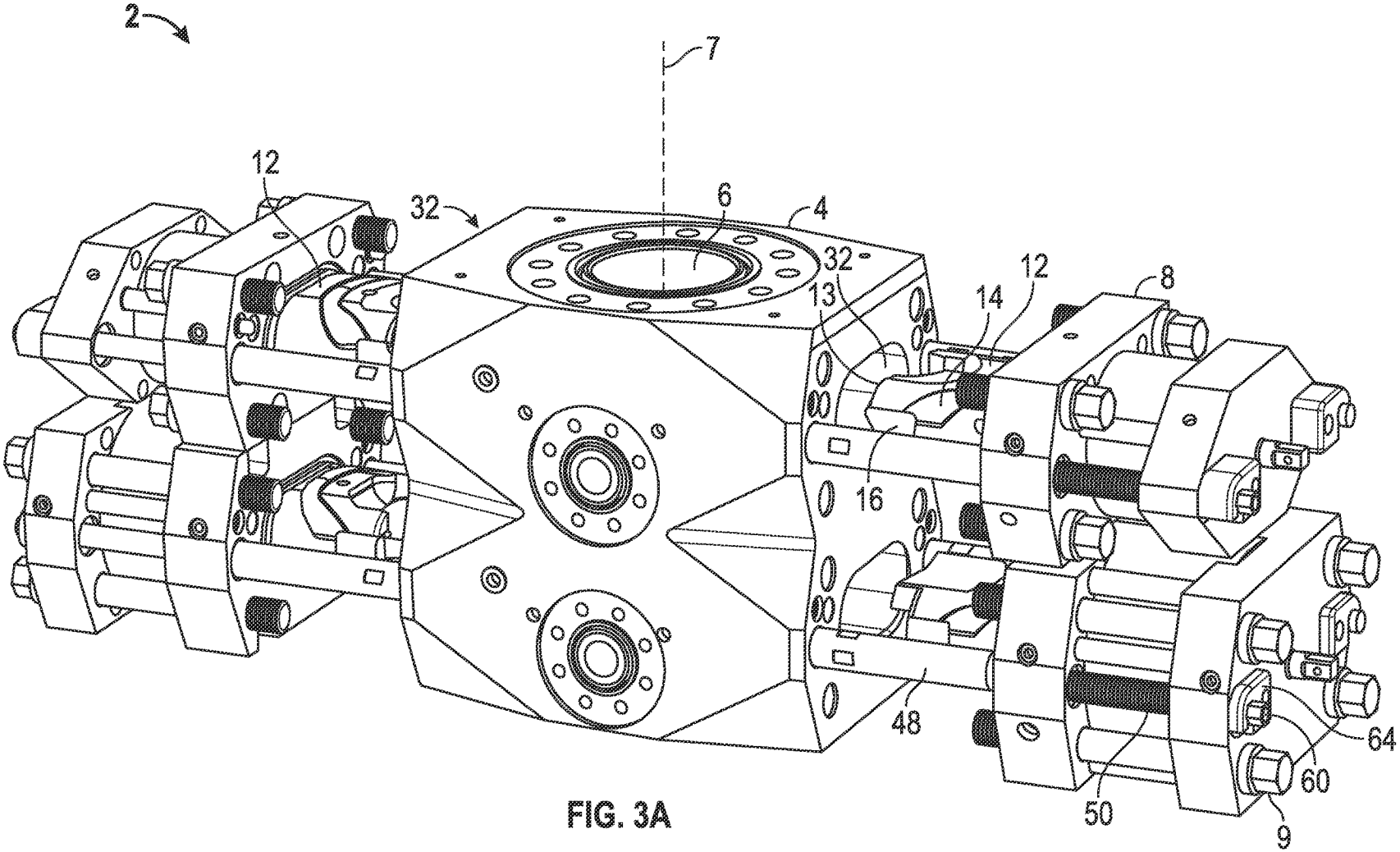
FIG. 3A is a perspective schematic view of the Type U blowout preventer ("BOP") of FIG. 1 with bonnets extended away from a body of the BOP.
Figure 3B:
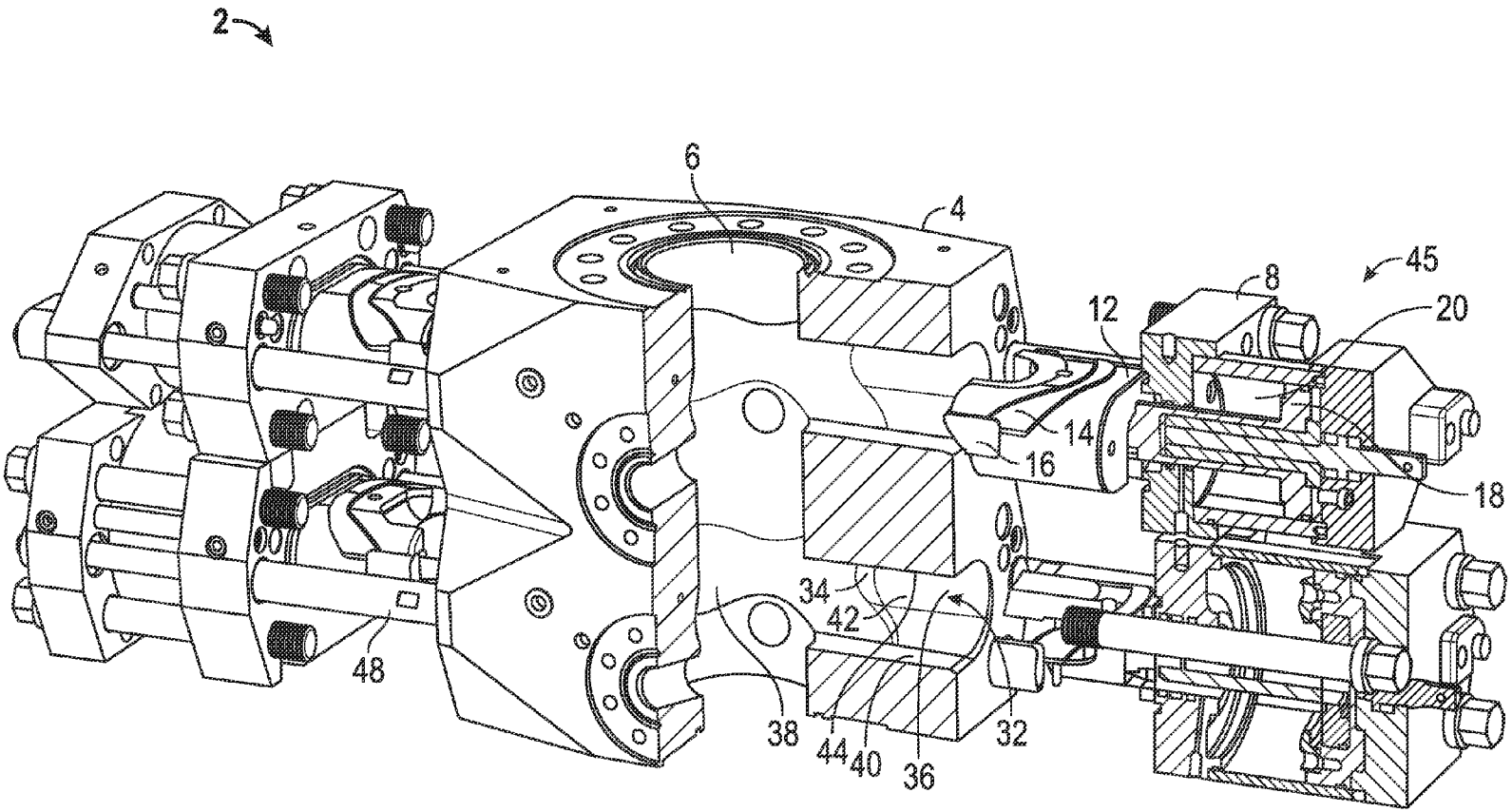
FIG. 3B is a perspective partial cross-sectional schematic view of the BOP of FIG. 3A.

FIG. 3A is a perspective schematic view of the Type U BOP of FIG. 1 with bonnets extended away from a body of the BOP. FIG. 3B is a perspective partial cross-sectional schematic view of the BOP of FIG. 3A. The figures will be described in conjunction with each other. The BOP 2 of the present invention includes a body 4 generally connected with a set of bonnets 8 during operation of the actuator 18 inside the chamber 20. As described above in FIGS. 1A, 1B for the ram bores 10, opposing ram bores 32 are formed in the body 4 that are transverse, generally perpendicular, to the longitudinal centerline 7 of the through-bore 6. One or more rams 12 with the top ram seal 14 and side rams seals 16, described above, are slidably disposed in the ram bores 32. For purposes herein, various combinations of seals are encompassed within the terms used herein. For example and without limitation, combining the seals 14, 16 into a single seal is encompassed by the terms "ram seals", in that the single seal would have a portion functioning as a top ram seal and a portion functioning as side seal portions.

However, in the present invention, the ram bores 32 are contoured bores to allow differential engagement of the ram 12 having the top ram seal 14 and the side ram seal 16 inside the contoured bore 32. The contoured bore 32 can be generally divided into three regions—a contour relief region 36 formed outwardly away from the centerline of the through-bore 6, a contour sealing region 38 disposed inwardly toward the centerline 7, and a contour transition region 34 therebetween. The Type U BOP ram seals 14, 16 do not substantially seal in the contour relief region 36. The ram seals 14, 16 start to seal in the contour transition region 34, then seal in the contour sealing region 38.

This differential sealing is in stark contrast to sealing in ram bores in conventional Type U BOPs. As discussed in the background, a conventional Type U BOP forms the ram bore to have a close tolerance fit with the Type U BOP seals along the entire length of the bore, and therefore the seals are in a constant state of compression. The seals can prematurely fail. Further, removing the ram with the seals from the bore typically requires additional features to exert an external hydraulic force to remove the ram from the bore, due to the tight compression of the ram seals with the bore.

The present invention allows the ram seals 14, 16 to be generally displaced from sealing by positioning the seals in the contour relief region 36 when the ram is not actuated toward the through-bore 6. Thus, the ram seals do not need to endure a constant state of compression. When the actuator 18 inside the chamber 20 extends the ram 12 toward the through-bore 6, the seals start to sealingly engage the contour transition region 34 and then sealingly engage the contour sealing region 38. To fully support the ram 12 during movement along the bore, a bottom 40 of the bore 32 may be flat, that is, may not be contoured. Thus, sides 42 and top 44 can be contoured for the differential sealing between the three regions.

In at least one embodiment, the bonnet 8 can be coupled to the body in conjunction with a tube 48 holding an extraction shaft 50 therein having a head 60 held to the bonnet with a retainer 64. The tube 48 and extraction shaft 50 allows the bonnet 8 to be extended away from the body 4 for repair and replacement without the need of a hydraulic external force, as in a conventional Type U BOP. This removal option is due in part to the differential engagement of the ram seal in the contoured bore. To disconnect the bonnet from the body, the bolts 9 are removed and the shaft 50 is rotated inside the tube 48. As the shaft 50 is rotated, the shaft moves longitudinally outwardly from the tube 48 and pushes the bonnet 8 away from the body 4. Because the ram 12 is initially positioned in the contour relief region 36, the ram seals 14, 16 do not constrain the extending of the bonnet 8 from the body 4. The shaft 50 extends sufficiently inside the tube 48 to support the bonnet 8 as the shaft is rotated inside the tube and the bonnet is extended away from the body 4.

Figure 4A:
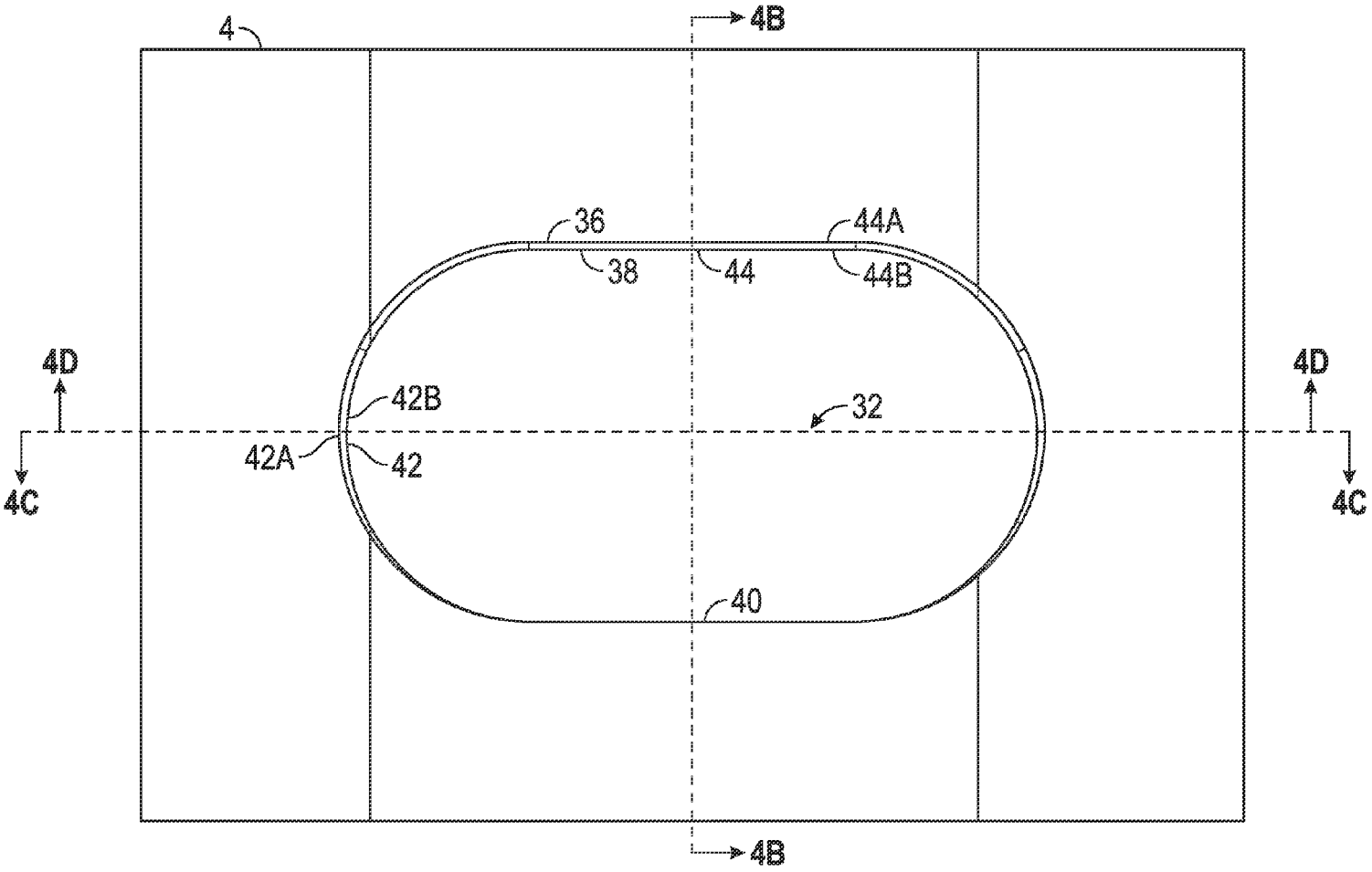
FIG. 4A is an end schematic view of a contoured ram bore in the BOP body, according to the present invention.
Figure 4B:
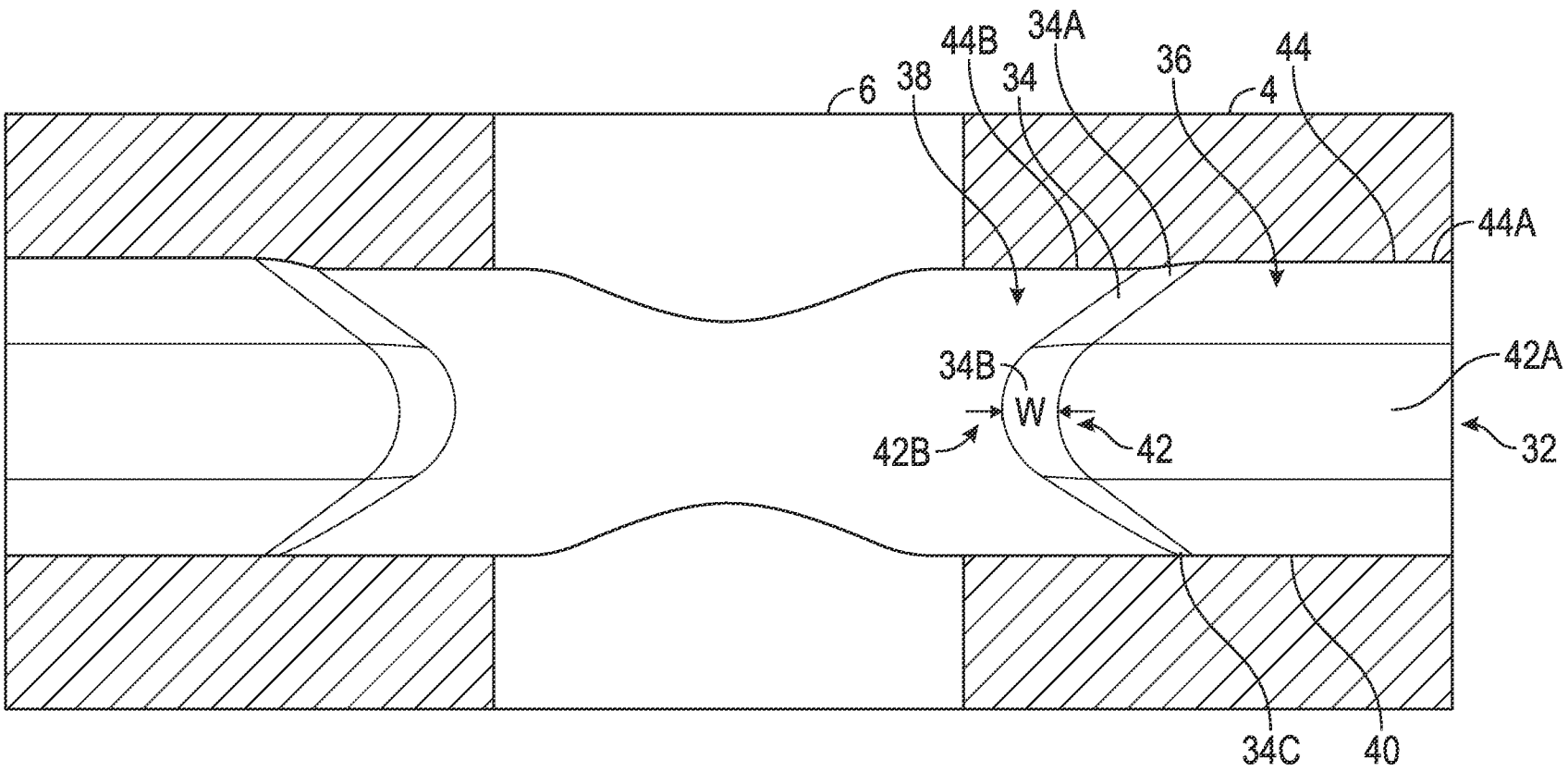
FIG. 4B is a side cross-sectional schematic view of the contoured ram bore in the BOP body.
Figure 4C:
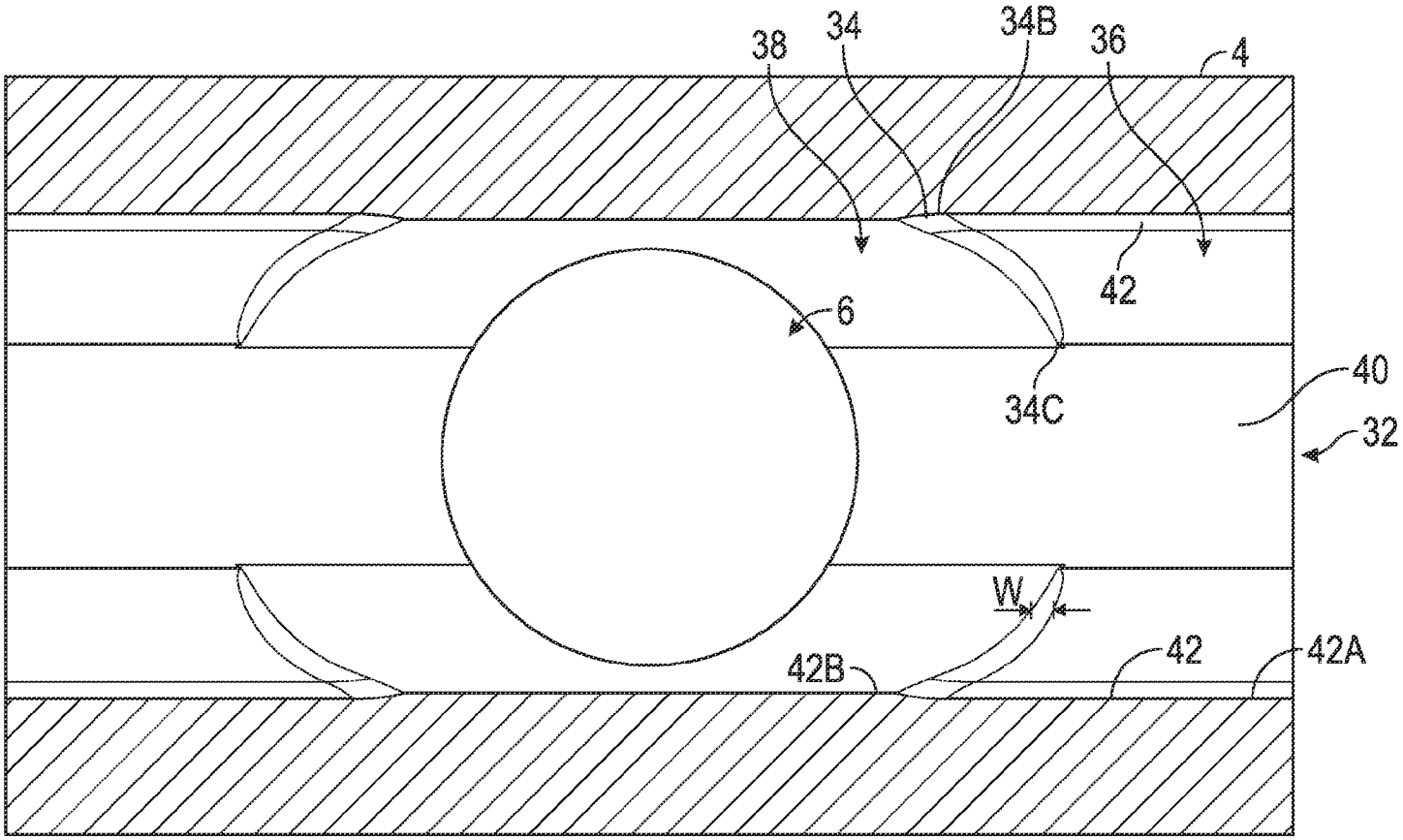
FIG. 4C is a bottom cross-sectional schematic view of the contoured ram bore.
Figure 4D:
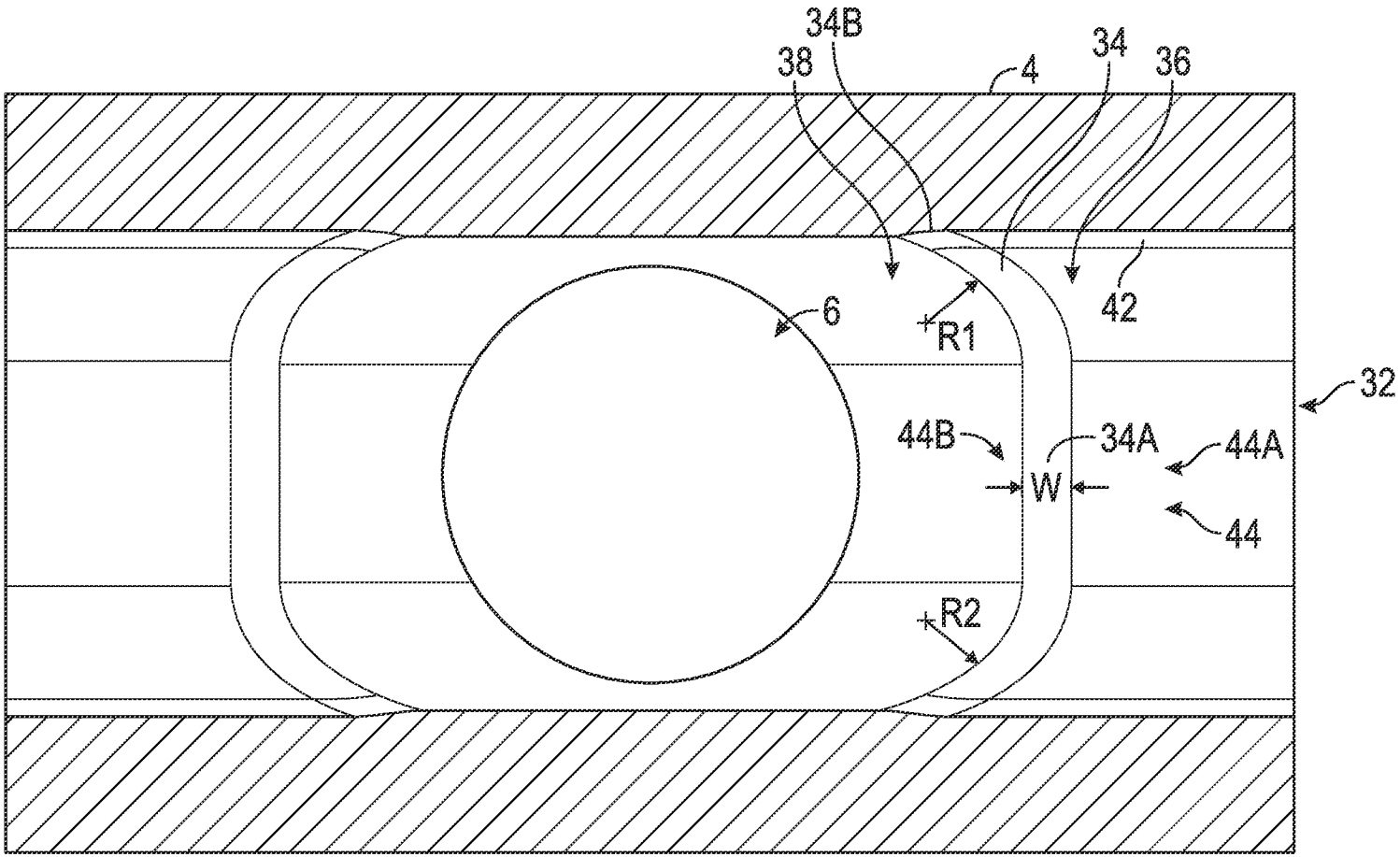
FIG. 4D is a top cross-sectional schematic view of the contoured ram bore.

FIG. 4A is an end schematic view of a contoured ram bore in the BOP body, according to the present invention. FIG. 4B is a side cross-sectional schematic view of the contoured ram bore in the BOP body. FIG. 4C is a bottom cross-sectional schematic view of the contoured ram bore. FIG. 4D is a top cross-sectional schematic view of the contoured ram bore. The figures are described in conjunction with each other.

The contoured bore 32 includes a bottom 40, sides 42, and top 44. The bottom 40 is not contoured and therefore does not include a transition portion, in at least one embodiment. The ram 12 is fully supported at a constant height along the bottom of the ram bore in the Type U BOP. The sides 42A are formed in the contour relief region 36 and therefore a larger cross-sectional dimension than the cross-sectional dimension of the sides 42B that is formed in the contour sealing region 38. Similarly, the top 44A is formed in the contour relief region 36 and therefore has a larger in cross-sectional dimension to the bottom 40 than the cross-sectional dimension of the top 44B to the bottom 40 that is formed in the contour sealing region 38.

The contour transition region 34 has an asymmetric, variable width W that is formed as the contour transition region intersects the different surfaces and resulting dimensions of the sides 42A, 42B, the tops 44A, 44B, and the bottom 40. As seen in FIG. 4B, the contour transition region has an upper portion 34A that is a transition between the tops 44A, 44B, a side portion 34B that is a transition between the sides 42A, 42B, and a lower portion 34C that is a transition between the sides 42A, 42B and the bottom 40. Further, the side portion 34B extends inwardly toward the through-bore 6 relative to the upper portion 34A. The side portion 34B can also extend inwardly relative to the lower portion 34C. As seen in FIG. 4C, the side portion 34B tapers to a smaller width W as it transitions to the lower portion 34C. As seen in FIG. 4D, the upper portion 34A of the contour transition region can include one or more curves having a radius R1, R2 between a central lateral portion.

The unique shape of the contour transition region 34 can correlate with the overall shape of the Type U BOP ram seals 14, 16. More particularly, the unique shape can minimize the contact of the ram seals 14, 16 with the contoured bore 32 at different positions along the bore, as described below.

Figure 5A:
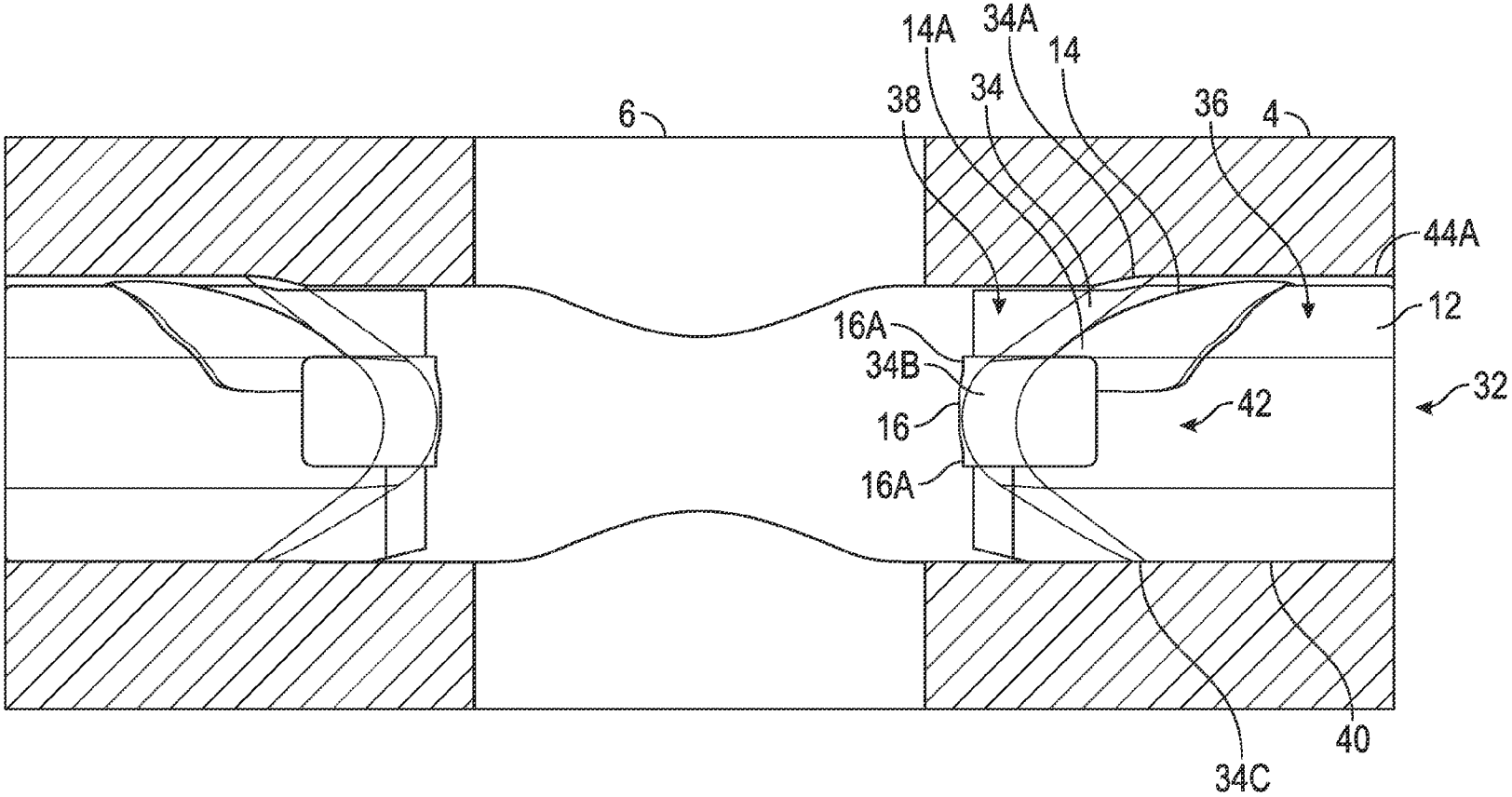
FIG. 5A is a side overview of a cross-sectional schematic of the contoured ram bore in the BOP body with an open ram and seals inserted therein.
Figure 5B:
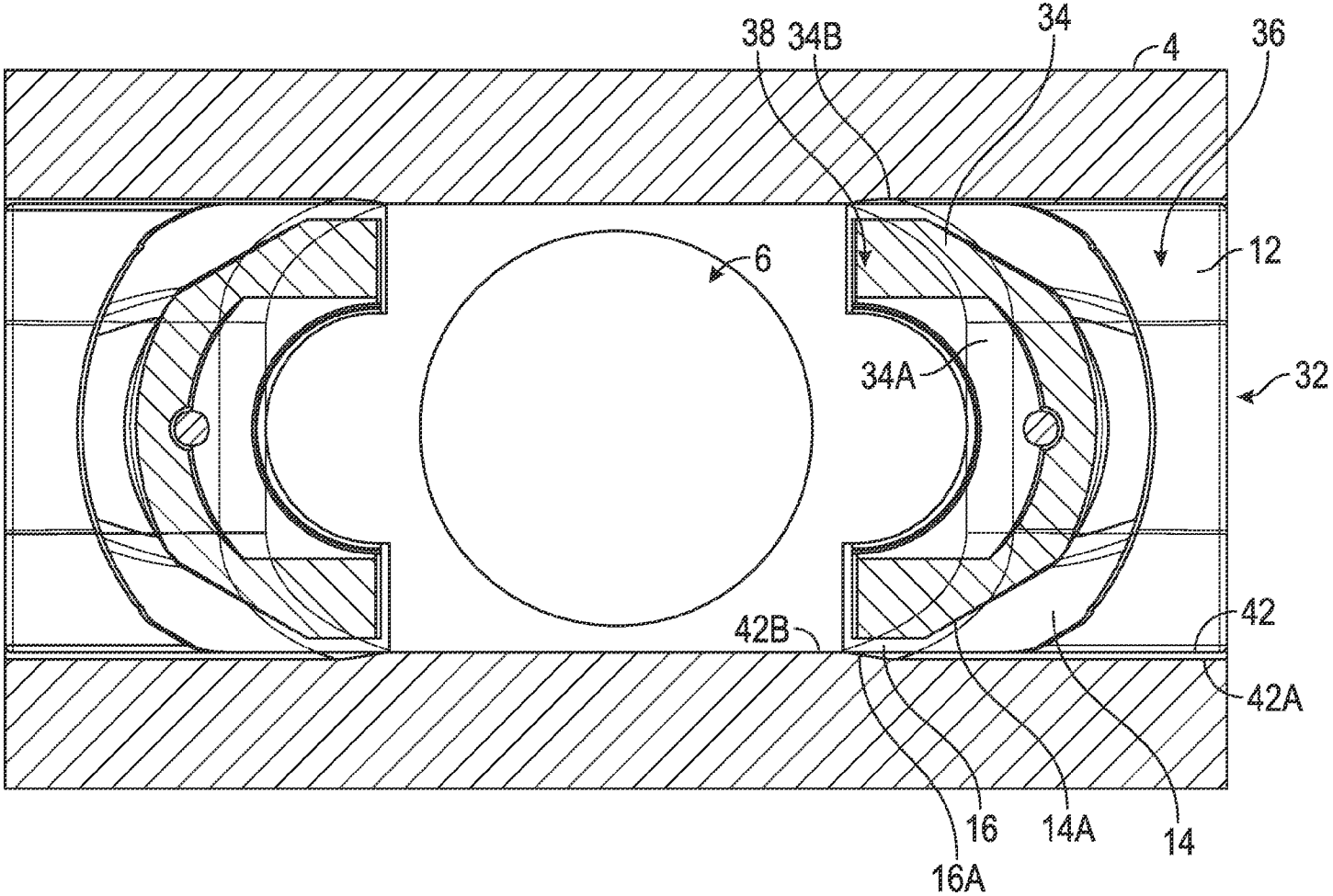
FIG. 5B is a top overview of a cross-sectional schematic of the contoured ram bore in the BOP body with an open ram and seals inserted therein.

FIG. 5A is a side overview of a cross-sectional schematic of the contoured ram bore in the BOP body with an open ram and seals inserted therein. FIG. 5B is a top overview of a cross-sectional schematic of the contoured ram bore in the BOP body with an open ram and seals inserted therein. FIG. 5B shows the contour transition region 34, the contour relief region 36, and the contour sealing region 38 with a ram 12 and the ram seals 14, 16 overlain on the image to show relative placement. The figures are described in conjunction with each other. The ram 12 is shown in a resting, retracted position in the contour bore 32 of the body 4. The positions of the top ram seal 14 and the side ram seal 16 relative to the contour transition region 34 shows that the ram seals are generally not engaged by the contour transition region 34 and the contour sealing region 38.

More specifically, the upper portions of the ram 12 and the top ram seal 14 are not significantly engaged, if at all, with the top 44A in the contour relief region 36. Similarly, the side of the ram 12 and the sides of the side ram seals 16 are not significantly engaged, if at all, with the sides 42A in the contour relief region 36. A small portion 14A of the top seal 14 can optionally overlap into the contour transition region 34 to assist in initiating an alignment of the top seal for when the ram 12 is actuated toward the through-bore 6. Similarly, a small portion 16A of the side seals 16 can optionally overlap into the contour transition region 34 to assist in initiating an alignment of the side seals for when the ram 12 is actuated toward the through-bore 6.

Figure 6A:
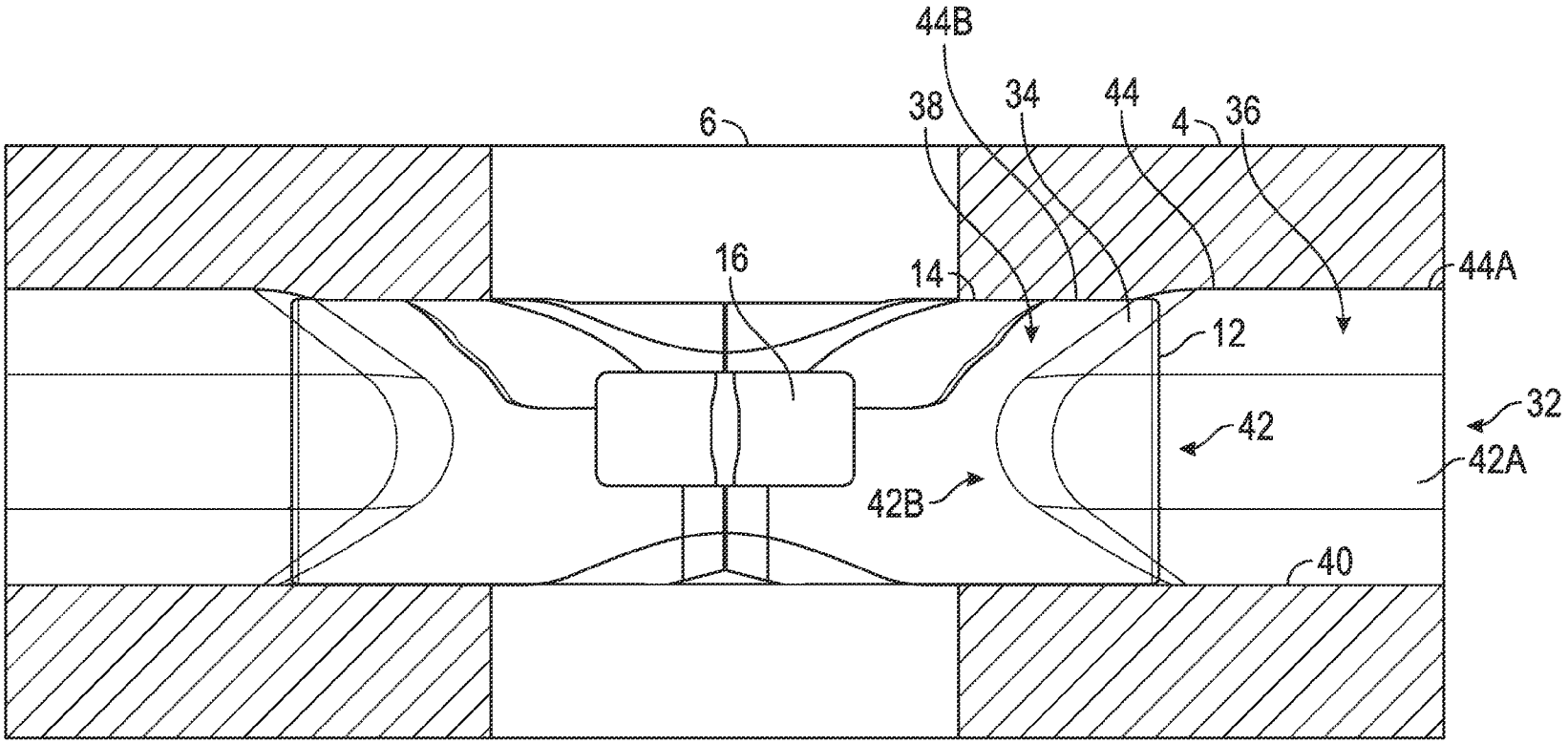
FIG. 6A is a side overview of a cross-sectional schematic of the contoured ram bore in the BOP body with a closed ram and seals inserted therein.
Figure 6B:
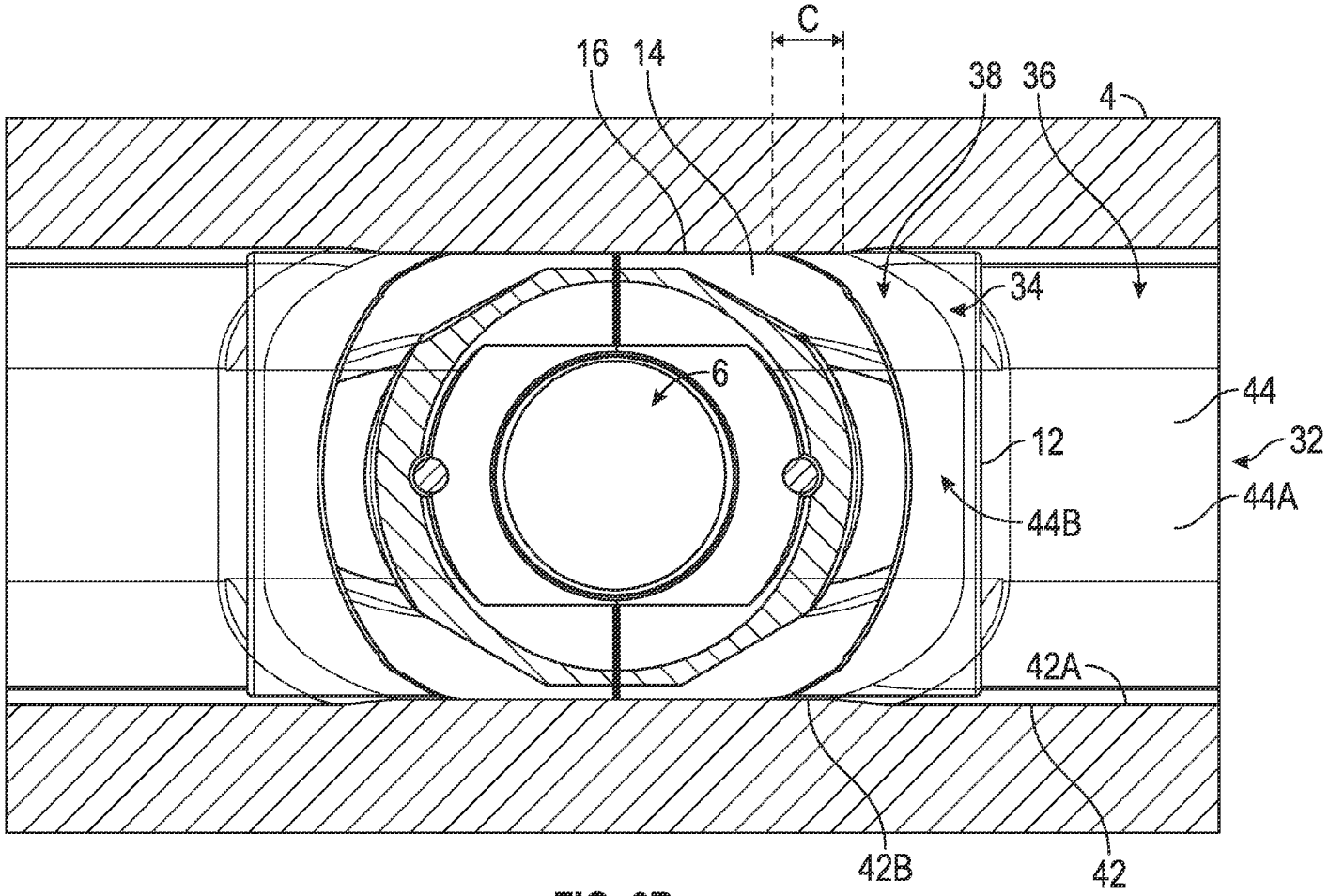
FIG. 6B is a top overview of a cross-sectional schematic of the contoured ram bore in the BOP body with a closed ram and seals inserted therein.

FIG. 6A is a side overview of a cross-sectional schematic of the contoured ram bore in the BOP body with a closed ram and seals inserted therein. FIG. 6B is a top overview of a cross-sectional schematic of the contoured ram bore in the BOP body with a closed ram and seals inserted therein. FIG. 6B shows the contour transition region 34, the contour relief region 36, and the contour sealing region 38 with a ram 12 and the ram seals 14, 16 overlain on the image to show relative placement. The figures are described in conjunction with each other. The ram 12 is shown in a fully closed, actuated position that is inwardly disposed in the contour bore 32 of the body 4 toward the through-bore 6. The positions of the top ram seal 14 and the side ram seal 16 relative to the contour transition region 34 shows that the ram seals are sealingly engaged in the contour sealing region 38. The top ram seal 14 is sealingly engaged with the top 44B in the contour sealing region 34. Similarly, the side ram seals 16 are sealingly engaged with the sides 42B in the contour sealing region 38. In at least one embodiment, the ram seals 14, 16 are disposed inwardly of the contour transition region 34 by a clearance "C" to ensure that the ram seals are engaged with the contour sealing region 38.

The ram 12 can be retracted in the normal course of operation by the actuator 18 in the chamber 20, as described above in FIG. 3B. Thus, the ram 12 can return to an unsealed, resting position in the contour relief region 36.

Figure 7A:
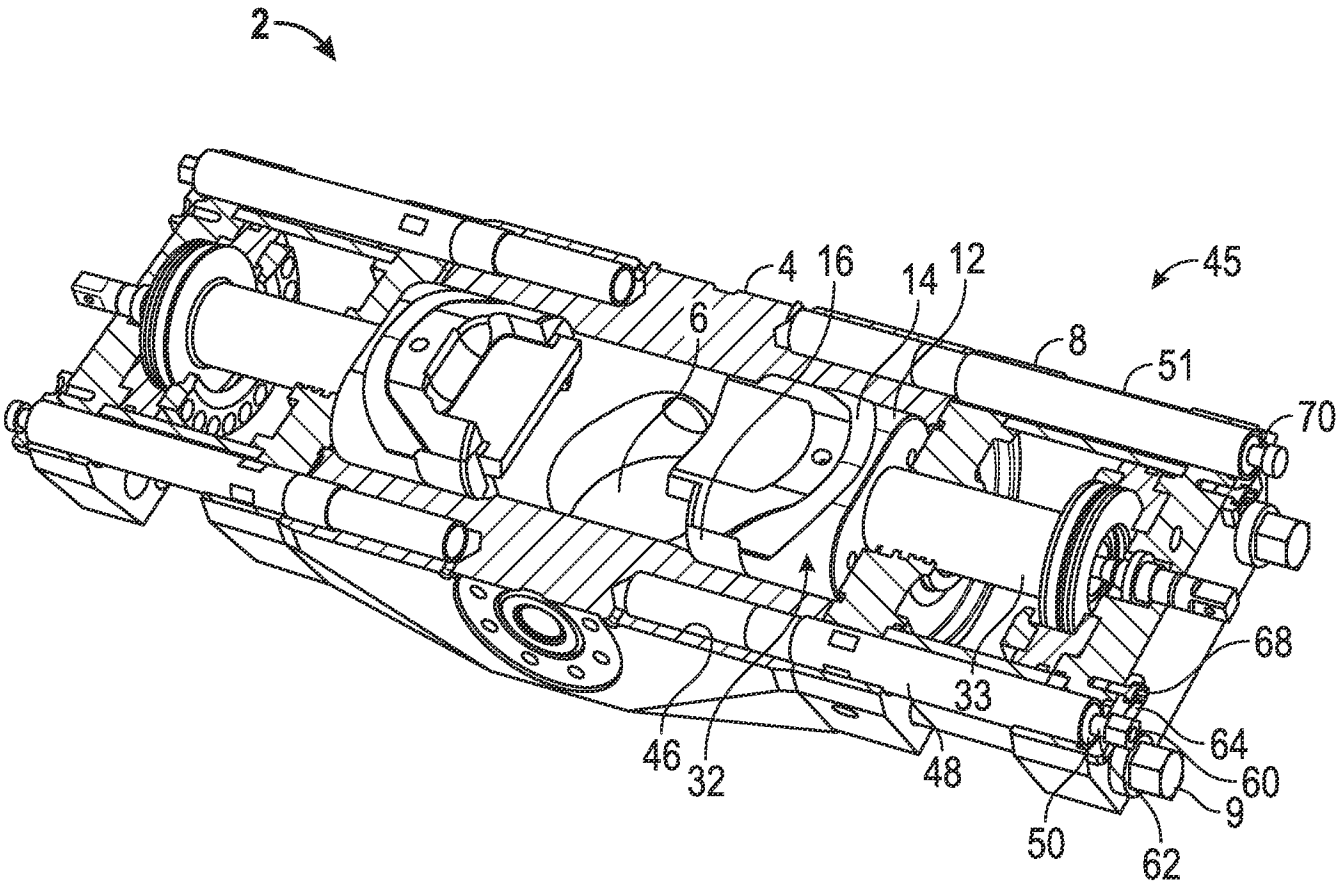
FIG. 7A is a perspective cross-sectional schematic view of the BOP with the bonnet connected to the BOP body with an extraction system.
Figure 7B:
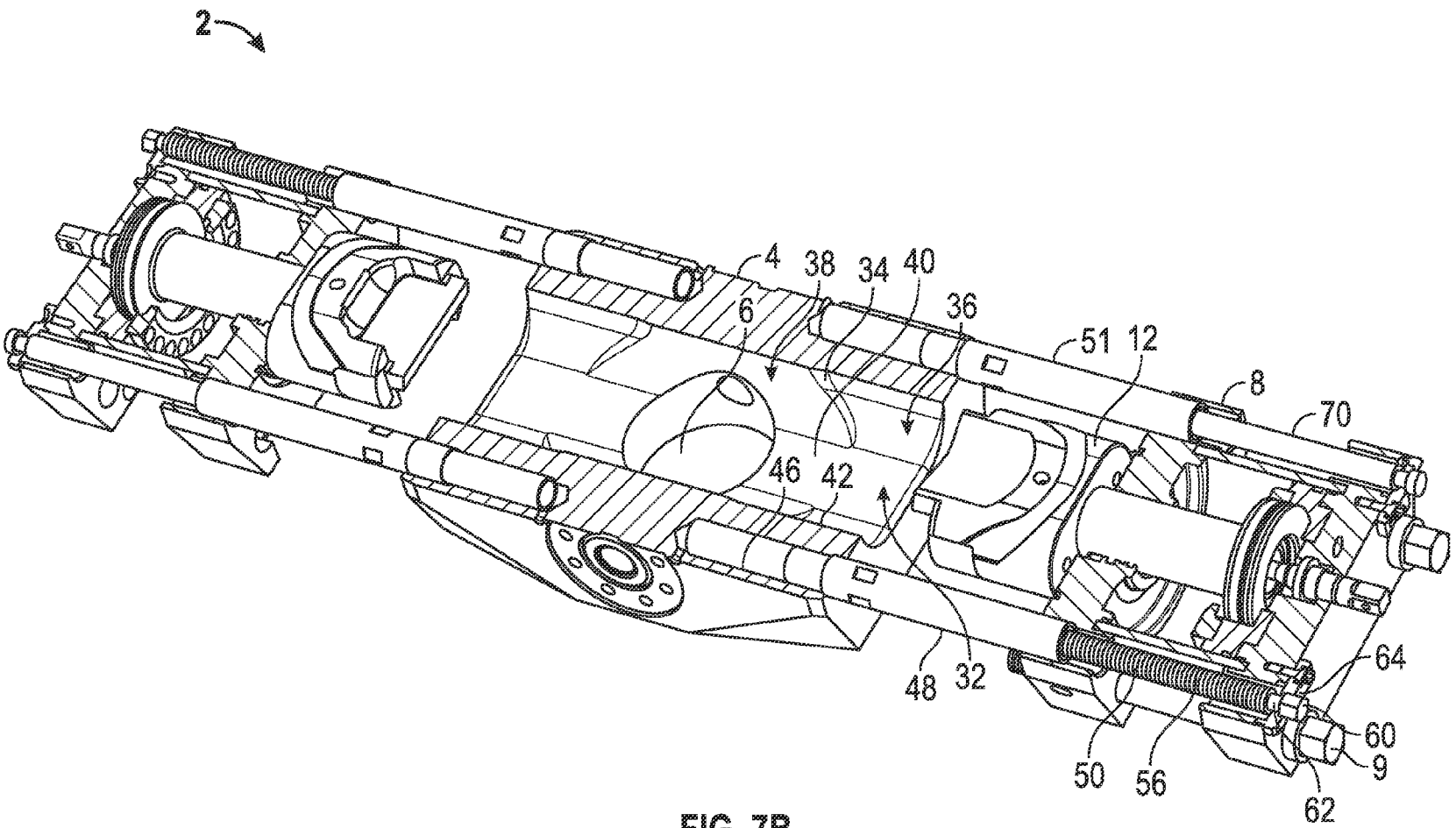
FIG. 7B is a perspective cross-sectional schematic view of the BOP with the bonnet extended away from the BOP body.

FIG. 7A is a perspective cross-sectional schematic view of the BOP with the bonnet connected to the BOP body with an extraction system. FIG. 7B is a perspective cross-sectional schematic view of the BOP with the bonnet extended away from the BOP body with the extraction system. The figures will be described in conjunction with each other. The bonnet 8 can be connected to the body 4 by fasteners 9, such as bolts. An extraction system 45 for extracting the bonnet 8 from the body 4 and engaging the bonnet to the body is further described. At least one bore 46 (and generally at least two bores) is formed in the body 4, such as to the side of the contour bore 32 and the ram 12, and generally aligned parallel with a longitudinal axis 33 of the contour bore 32 in which the ram travels. A tube 48 is disposed in each bore 46 and coupled thereto. The tube 48 can be of various shapes and lengths and generally has an internal hollow portion. In at least one embodiment, the tube 48 can include external threads along a portion of the length of the tube's outside perimeter and engage corresponding internal threads in the bore 46 to secure the tube longitudinally in the bore 46. Other forms of coupling can be used. The tube 48 can extend outwardly and slidably pass through one or more corresponding bores 47 in the bonnet 8 for the bonnet to be slidably coupled along the tube.

An extraction shaft 50 is disposed inside the tube 48. In at least one embodiment, the extraction shaft 50 includes a head 60 that can be used to rotate the shaft relative to the tube 48. In at least one embodiment, the shaft 50 can include a shaft engagement portion 56 having threads and be threadably engaged with the tube 48 as a jack screw, so that the shaft extends outwardly or retracts inwardly relative to the tube as the shaft is rotated. The shaft 50 is longitudinally coupled to the bonnet 8 by a retainer 64. The retainer 64 can slide around a narrow portion, herein neck 52, of the shaft 50 to allow the shaft 50 to rotate, yet be restrained longitudinally with the bonnet 8. The retainer itself is coupled to the bonnet by a fastener 68, such as a bolt.

Another tube 51, disposed distally from the tube 48 relative to the contoured bore 32, can include a guide shaft 70. The guide shaft 70 may not be threadably engaged with the tube 51 and may be slidably engaged to help guide the bonnet and maintain alignment as the bonnet is moved with the extraction shaft 50.

When the bonnet 8 is moved away from the body 4 and the ram 12 has cleared the contoured bore 32, the retainers 60 that couple the shafts 50 and 70 to the bonnet can be removed from the bonnet to release the shafts. The bonnet 8 and components coupled thereto can be removed from the body for repair or replacement.

Figure 8A:
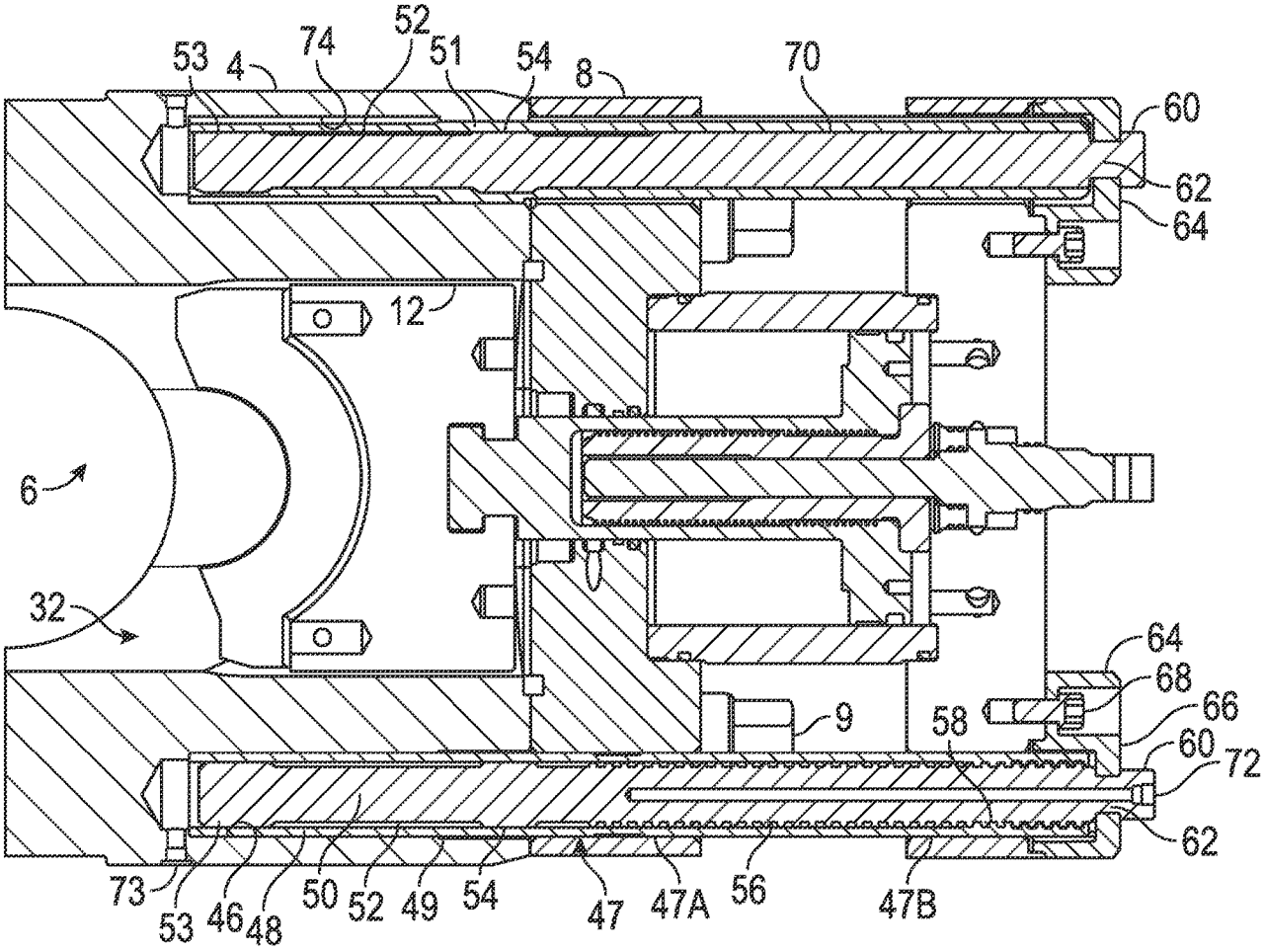
FIG. 8A is a top cross-sectional schematic view of the BOP with the bonnet connected to the BOP body.
Figure 8B:
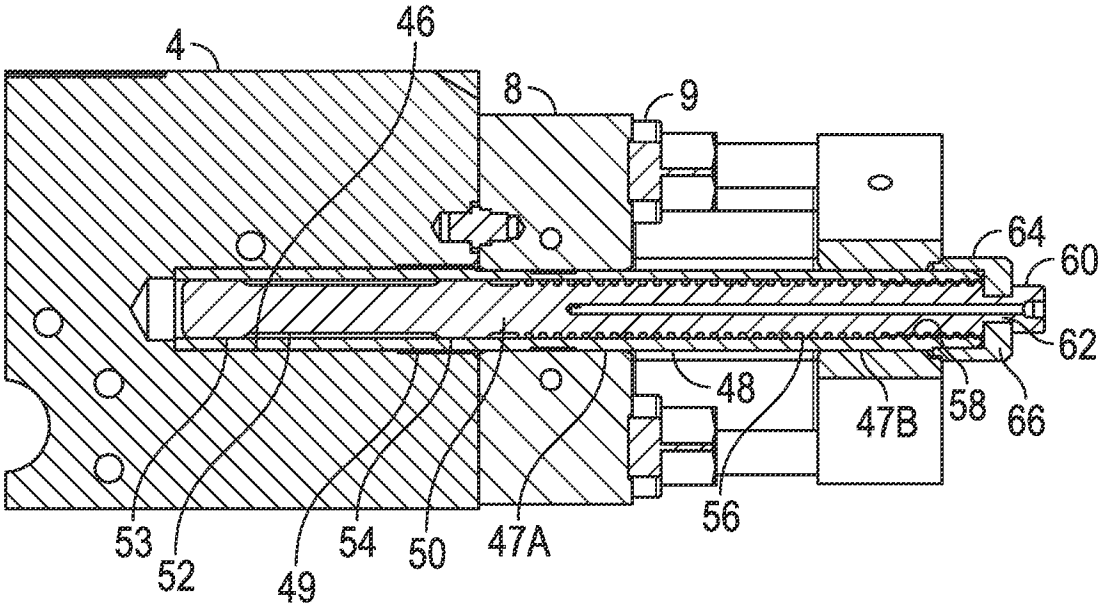
FIG. 8B is a side cross-sectional schematic view of the BOP with the bonnet connected to the BOP body.

FIG. 8A is a top cross-sectional schematic view of the BOP with the bonnet connected to the BOP body. FIG. 8B is a side cross-sectional schematic view of the BOP with the bonnet connected to the BOP body. The figures will be described in conjunction with each other. FIGS. 8A, 8B provide additional details over the perspective views of FIGS. 7A, 7B. The bonnet 8 is tightly coupled to the body 4 with the fasteners 9. The tube 48 is securely coupled in the bore 46 of the body 4. In at least one embodiment, the tube 48 can include a coupling portion 49 on the external periphery of the tube to mate with a corresponding coupling portion in the bore 46. The bonnet 8 can include one or more bores 47A, 47B (collectively bore 47) in portions of the bonnet through which the tube 48 slidably passes.

The extraction shaft 50 can include one or more shaft support portions, such as shaft support portions 53, 54. The shaft support portions 53, 54 can rotate with the shaft inside the tube 48 and provide bending support and alignment for the bonnet 8, as the bonnet is moved away from the body 4. A reduced shaft portion 52 disposed between the shaft support portions 53, 54 can provide clearance to reduce friction as the shaft rotates and provides an annular space for lubrication. The extraction shaft 50 can also include a shaft engagement portion 56 that can include threads to engage with a corresponding tube engagement portion 58 that can include corresponding threads on the internal surface of the tube 48.

The retainer 64 can be coupled to the bonnet 8 with a fastener 68. Further, the retainer 64 can retain the extraction shaft 50 to the bonnet 8 and allow the shaft to rotate relative thereto. The retainer 64 can include a retainer extension 66 that can at least partially surround a reduced diameter neck 62 of the shaft 50 inwardly from the head 60. Thus, the shaft 50 can rotate inside the tube 48 while the neck 62 rotates within the retainer extension 66. As the shaft 50 moves longitudinally relative to the tube 48 during the shaft's rotation, the bonnet 8 moves with the shaft 50.

Various lubrication openings can be included in and around the rotating and sliding components. For example, a lubrication opening 72 can extend longitudinally in the shaft 50 and exit the outer periphery to lubricate portions thereof, and a lubrication opening 73 can extend from an exterior surface of the body 4 to the bore 46 in the body and lubricate portions of the shaft 50 in the tube 48 exposed to the bore 46.

A second tube 51 similar to the tube 48 can be similarly coupled in a second bore 74 of the body 4 distal from the bore 46 relative to the contoured bore 32. A guide shaft 70 can be slidably disposed inside the tube 51. The guide shaft 70 can include similar aspects of the extraction shaft 50, such as the shaft support portions 53, 54 and the reduced shaft portion 52. However, the guide shaft 70 need not have the shaft engagement portion 56 of the extraction shaft 50, because the guide shaft 70 is intended to primarily slidably support and guide the bonnet 8 and components coupled thereto. The guide shaft 70 can assist in supporting the bonnet 8 and maintaining alignment as the bonnet is moved away from or toward the body 4.

Figure 9A:
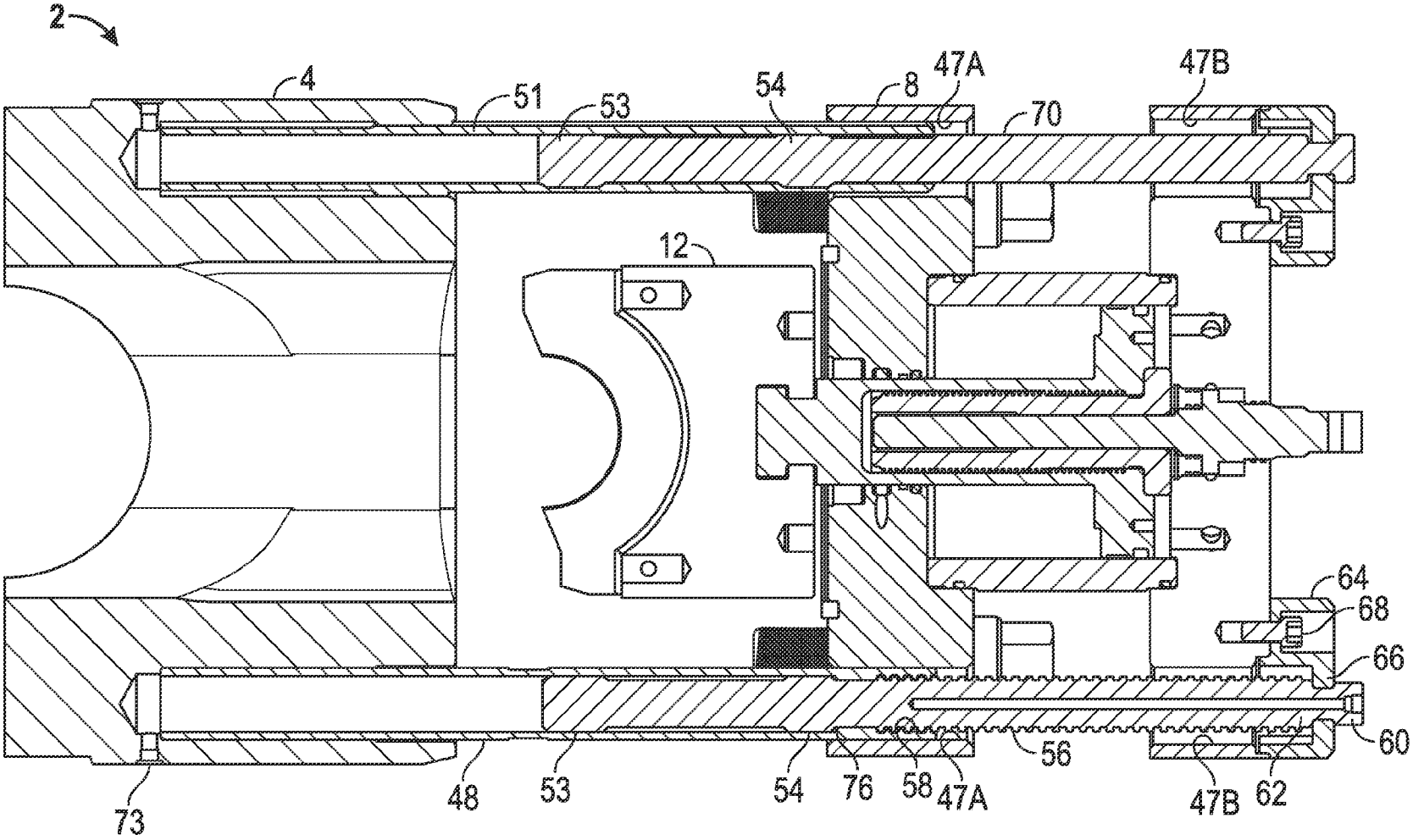
FIG. 9A is a top cross-sectional schematic view of the BOP with the bonnet extended away from the BOP body.
Figure 9B:
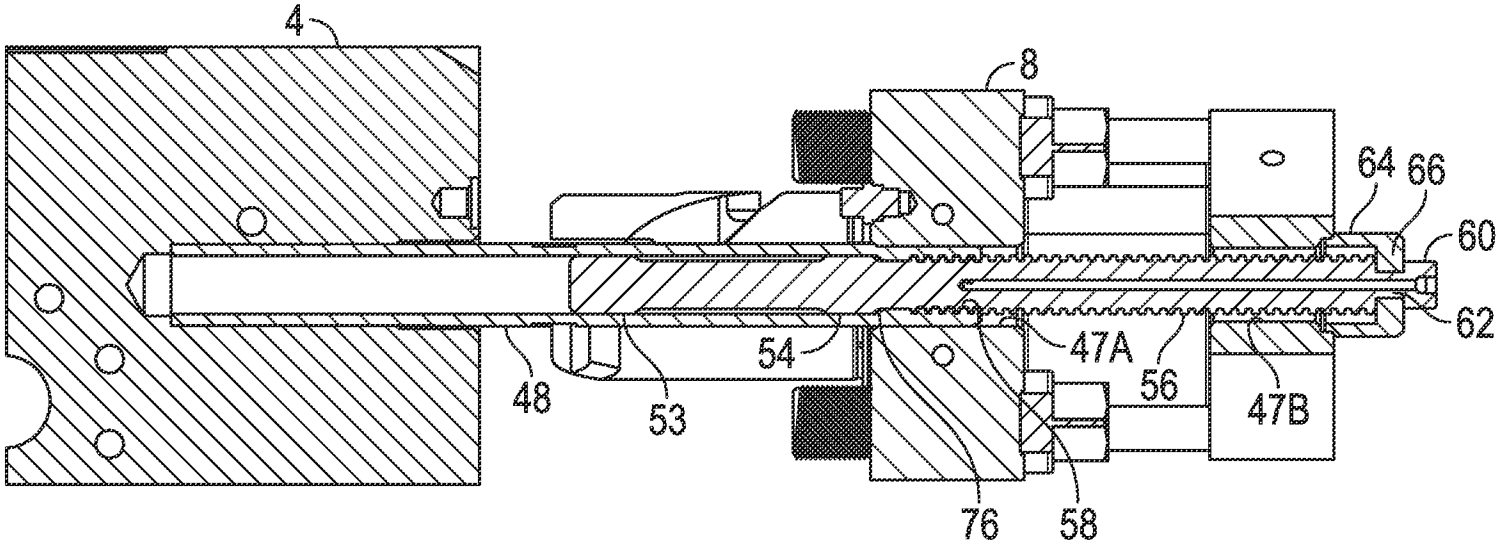
FIG. 9B is a side cross-sectional schematic view of the BOP with the bonnet extended away from the BOP body.

FIG. 9A is a top cross-sectional schematic view of the BOP with the bonnet extended away from the BOP body. FIG. 9B is a side cross-sectional schematic view of the BOP with the bonnet extended away from the BOP body. The figures will be described in conjunction with each other. FIGS. 9A, 9B provide additional details over the perspective views of FIGS. 7A, 7B.

To disconnect the bonnet 8 from the body 4, the fasteners 9 are loosened. The head 60 of the shaft 50 is rotated, so that the shaft 50 rotates. The shaft engagement portion 56 of the shaft 50 rotates relative to the tube engagement portion 58 and the shaft 50 moves away from the body 4 with the bonnet 8 following the movement of the shaft 50. The bonnet 8 slides along the outside perimeter of the tubes 46, 51 disposed through the bores 47 in the bonnet. The guide shaft 70 in the tube 51 assists in maintaining support and alignment of the bonnet 8 as the bonnet moves away from or toward the body 4. The shaft support portions 53, 54 rotate with the shaft 50 and slide along the inside perimeter of the tube 48 until a shoulder 76 on the shaft support portion 54 engages the tube engagement portion 58 and stops the shaft from further rotation and further movement outwardly away from the through-bore 6. The shaft support portions 53, 54 on the shafts 50, 70 support the bonnet 8 in the outwardly extended position. The ram 12 generally has cleared the contoured bore 32. Maintenance can be performed on the ram 12, ram seals, and other components. Further, if the bonnet 8 needs removal from the body 4, the retainers 64 for the shafts 50, 70 can be removed by removing the fasteners 68 to allow the bonnet to be decoupled from the shafts.

Other and further embodiments utilizing one or more aspects of the inventions described above can be devised without departing from the spirit of the disclosed invention. For example and without limitation, various alternatives to threads, various numbers and locations of tubes in the body for use with extraction and guide shafts, various retainers for coupling the shafts with the bonnet, various fasteners, and other variations are possible and contemplated. Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

The invention claimed is:

1. A Type U blowout preventer ("BOP") for an oil or gas well, comprising:

a BOP body having a through-bore defining a centerline and configured to allow a tubular member to be disposed therethrough, the body having at least a first contoured ram bore formed transverse to the through-bore centerline, the contoured ram bore formed with at least three regions comprising a contour relief region formed outwardly away from the centerline of the through-bore, a contour sealing region disposed inwardly toward the through-bore, and a contour transition region therebetween, the contour transition region defining a side portion and an upper portion, wherein the side portion extends inwardly toward the through-bore relative to the upper portion, and wherein the contour relief region has a larger cross-sectional dimension compared to the contour sealing region; and a first ram slidably disposed in the first ram bore such that the first ram is supported at a constant height throughout the first ram bore, the first ram having elastomeric seals to seal against the ram bore comprising a top ram seal disposed on top of the ram and a side ram seal disposed on each side of the ram with the side ram seal being disposed toward a leading edge of the ram toward the through-bore, and the top ram seal being disposed distal from the leading edge relative to the side seal.

2. The BOP of claim 1, further comprising a second ram contoured bore formed in the BOP body and a second ram slidably disposed in the second ram bore with a first and second bonnet coupled to the respective ram bores.

3. The BOP of claim 1, wherein the contour relief region has a larger side cross-sectional dimension and a larger top to bottom cross-sectional dimension compared to the contour sealing region.

4. The BOP of claim 1, wherein the contour relief region defines an asymmetric, variable width as the contour relief region intersects a bottom, sides, and a top of the contoured ram bore.

5. The BOP of claim 1, wherein the contour relief region defines a width, and the contour relief section side portion has a larger width than the contour relief region upper portion.

6. The BOP of claim 1, wherein the contour bore further comprises a flat bottom.

7. The BOP of claim 1, wherein the contour bore further comprises a flat bottom, and wherein the contour relief section is formed with a lower portion and wherein the side portion tapers in width to the lower portion.

8. The BOP of claim 1, wherein the contour relief section has a lower portion and wherein the side portion extends inwardly toward the through-bore relative to the lower portion.

9. The BOP of claim 1, wherein the contour relief region defines a width, and wherein the contour relief section has a lower portion, wherein the contour relief section side portion has a larger width than the contour relief region lower portion.

10. The BOP of claim 1, further comprising a bonnet having a hydraulic chamber and coupled to the body, the bonnet comprising an actuator disposed in the chamber and coupled to the ram, the actuator configured to extend the ram toward the through-bore and retract the ram away from the through-bore.

11. The BOP of claim 1, further comprising a bonnet configured to be coupled to the body, the bonnet comprising an extraction system to disconnect the bonnet from the body, the extraction system comprising:

a first tube fixedly coupled to the body and slidably coupled within at least a portion of the bonnet; and an extraction shaft rotatably coupled to the bonnet and slidably disposed at least partially within the tube, comprising:

at least one shaft support portion slidably coupled to the tube to support the bonnet outside the tube; and at least one shaft engagement portion configured to engage a corresponding tube engagement portion and move the shaft longitudinally relative to the tube when the shaft is rotated.

12. The BOP of claim 11, wherein the extraction shaft is rotatably coupled to the bonnet with a removable retainer configured to allow the bonnet to be decoupled from the extraction shaft and the body.

13. The BOP of claim 11, further comprising:

a second tube fixedly coupled to the body distal from the first tube relative to the ram bore and slidably coupled within at least a portion of the bonnet; and a guide shaft rotatably coupled to the bonnet and slidably disposed at least partially within the second tube, the guide shaft comprising at least one shaft support portion slidably coupled to the second tube to support the bonnet outside the second tube.

14. The BOP of claim 1, further comprising a plurality of BOPs coupled together.

15. The BOP of claim 1, wherein the contour transition region upper portion comprises a shape having at least two radii.

16. The BOP of claim 1, wherein the side ram seal, the top ram seal, or a combination thereof partially engages the contour transition region in a retracted position away from the through-bore.

17. The BOP of claim 1, wherein the side ram seal and the top ram seal engage the contour sealing region in an extended position toward the through-bore.

18. A Type U blowout preventer ("BOP") for an oil or gas well, comprising:

a BOP body having a through-bore defining a centerline and configured to allow a tubular member to be disposed therethrough, the body having at least a first contoured ram bore formed transverse to the through-bore centerline, the contoured ram bore formed with at least three regions comprising a contour relief region formed outwardly away from the centerline of the through-bore, a contour sealing region disposed inwardly toward the through-bore, and a contour transition region therebetween, the contour relief region having at least one cross-sectional dimension larger than the contour sealing region;

a first ram slidably disposed in the first ram bore, the first ram having at least one elastomeric seal to seal against the ram bore; and a bonnet configured to be coupled to the body, the bonnet comprising an extraction system to disconnect the bonnet from the body, the extraction system comprising:

a first tube fixedly coupled to the body and slidably coupled within at least a portion of the bonnet; and an extraction shaft rotatably coupled to the bonnet and slidably disposed at least partially within the tube, comprising:

at least one shaft support portion slidably coupled to the tube to support the bonnet outside the tube; and at least one shaft engagement portion configured to engage a corresponding tube engagement portion and move the shaft longitudinally relative to the tube when the shaft is rotated.

19. The BOP of claim 18, wherein the extraction shaft is rotatably coupled to the bonnet with a removable retainer configured to allow the bonnet to be decoupled from the extraction shaft and the body.

20. The BOP of claim 18, further comprising:

a second tube fixedly coupled to the body distal from the first tube relative to the ram bore and slidably coupled within at least a portion of the bonnet; and a guide shaft rotatably coupled to the bonnet and slidably disposed at least partially within the second tube, the guide shaft comprising at least one shaft support portion slidably coupled to the second tube to support the bonnet outside the second tube.

21. A Type U blowout preventer ("BOP") for an oil or gas well, comprising:

a BOP body having a through-bore defining a centerline and configured to allow a tubular member to be disposed therethrough, the body having at least a first contoured ram bore formed transverse to the through-bore centerline, the contoured ram bore formed with at least three regions comprising a contour relief region formed outwardly away from the centerline of the through-bore, a contour sealing region disposed inwardly toward the through-bore, and a contour transition region therebetween, the contour relief region having at least one cross-sectional dimension larger than the contour sealing region; and a first ram slidably disposed in the first ram bore such that the first ram is supported at a constant height throughout the first ram bore, the first ram having elastomeric seals to seal against the ram bore comprising a top ram seal disposed on top of the ram and a side ram seal disposed on each side of the ram with the side ram seal being disposed toward a leading edge of the ram toward the through-bore, and the top ram seal being disposed distal from the leading edge relative to the side seal.

* * * * *